US008284124B2

(12) United States Patent
Kim et al.

(10) Patent No.: US 8,284,124 B2
(45) Date of Patent: Oct. 9, 2012

(54) ORGANIC ELECTROLUMINESCENT DISPLAY DEVICE AND DRIVING METHOD OF THE SAME

(75) Inventors: Jin-Hyoung Kim, Goyang-si (KR); In-Hwan Kim, Seoul (KR); Seung-Chan Byun, Incheon (KR); Sang-Ho Yu, Seongnam-si (KR)

(73) Assignee: LG Display Co., Ltd., Seoul (KR)

( * ) Notice: Subject to any disclaimer, the term of this patent is extended or adjusted under 35 U.S.C. 154(b) by 712 days.

(21) Appl. No.: 11/646,855

(22) Filed: Dec. 28, 2006

(65) Prior Publication Data

US 2007/0296651 A1 Dec. 27, 2007

(30) Foreign Application Priority Data

Jun. 27, 2006 (KR) ..... 10-2006-0057983

(51) Int. Cl.
*G09G 3/32* (2006.01)
*G09G 3/30* (2006.01)

(52) U.S. Cl. ..... 345/76; 345/82

(58) Field of Classification Search ..... 345/76–83
See application file for complete search history.

(56) References Cited

U.S. PATENT DOCUMENTS 7,319,446 B2 * 1/2008 Oh et al. ..... 345/76
2002/0118150 A1 * 8/2002 Kwon ..... 345/76
2003/0112205 A1 * 6/2003 Yamada ..... 345/32
2004/0095298 A1 * 5/2004 Miyazawa ..... 345/76
2005/0104820 A1 * 5/2005 Komiya ..... 345/76
2005/0219187 A1 * 10/2005 Shih ..... 345/94
2006/0066527 A1 * 3/2006 Chou ..... 345/76
2006/0097628 A1 * 5/2006 Suh et al. ..... 313/504
2007/0030219 A1 * 2/2007 Park et al. ..... 345/76
2007/0128583 A1 * 6/2007 Miyazawa ..... 434/433

FOREIGN PATENT DOCUMENTS

CN 1427382 A 7/2003

OTHER PUBLICATIONS

Office Action issued in corresponding Chinese Patent Application No. 2006101682075; issued Jan. 16, 2009.

* cited by examiner

*Primary Examiner* — Amr Awad
*Assistant Examiner* — Stephen Bray
(74) *Attorney, Agent, or Firm* — Brinks Hofer Gilson & Lione

(57) ABSTRACT

An organic electroluminescent display device includes an organic light-emitting diode, a first transistor outputting a data voltage by an nth scan signal (n is a natural number), a second transistor providing a current to the organic light-emitting by the data voltage, a capacitor storing the data voltage, and a third transistor supplying the second transistor and the capacitor with a pre-charge voltage by an (n−1)th scan signal, the pre-charge voltage having an opposite polarity to the data voltage.

10 Claims, 4 Drawing Sheets

ORGANIC ELECTROLUMINESCENT DISPLAY DEVICE AND DRIVING METHOD OF THE SAME

This application claims the benefit of Korean Patent Application No. 2006-0057983, filed on Jun. 27, 2006, which is hereby incorporated by reference as if fully set forth herein.

FIELD OF THE INVENTION

The present invention relates to an organic electroluminescent display device, and more particularly, to an organic electroluminescent display device displaying high quality images and a driving method of the same.

DISCUSSION OF THE RELATED ART

A liquid crystal display (LCD) device has been widely used for its numerous advantages including light weight, thinness, and low power consumption. However, since the LCD device is not self-luminescent, the LCD device requires an additional light source such as a backlight unit.

On the other hand, an organic electroluminescent display device emits light by injecting electrons from a cathode electrode and holes from an anode electrode into an emissive layer, combining the electrons and the holes to generate an exciton, and by the exciton transitioning from an excited state to a ground state. Since the organic electroluminescent display device does not require an additional light source due to its self-luminescence property, the organic electroluminescent display device has a small size and is light weight, as compared to a liquid crystal display (LCD) device. The organic electroluminescent display device also has low power consumption, high brightness, and a short response time. In addition, the organic electroluminescent display device can have reduced manufacturing costs because of its simple manufacturing processes.

FIG. 1 is an equivalent circuit for a pixel of an organic electroluminescent display (OELD) device according to the related art, and FIG. 1 shows a pixel of a two-thin film transistor structure.

As shown in FIG. 1, a scan line S and a data line D define a pixel region. In the pixel region, a switching thin film transistor (TFT) N1, a capacitor C, a driving thin film transistor (TFT) N2, and an organic light-emitting diode OLED are formed. The switching TFT N1 and the driving TFT N2 are NMOS (n-channel metal-oxide-semiconductor) transistors and include amorphous silicon (a-Si:H).

A gate electrode of the switching TFT N1 is connected to the scan line S, and a source electrode of the switching TFT N1 is connected to the data line D. One electrode of the capacitor C is connected to a drain electrode of the switching TFT N1, and the other electrode of the capacitor C is connected to a ground GND. A gate electrode of the driving TFT N2 is connected to the drain electrode of the switching TFT N1 and the one electrode of the storage capacitor C1, a source electrode of the driving TFT N2 is connected to the ground GND, and a drain electrode of the driving TFT N2 is connected to a cathode of the organic light-emitting diode OLED. An anode of the organic light-emitting diode OLED is connected to a power supply line VDD providing driving voltages.

The organic electroluminescent display device having the above-mentioned structure can be driven as follows with reference to FIG. 2. FIG. 2 shows a timing chart of the organic electroluminescent display device.

The switching TFT N1 turns ON by a positive selecting voltage VGH supplied from a nth scan line S(n) (n is a natural number), and the capacitor C is charged due to a data voltage Vdata supplied from the data line D. The data voltage Vdata is positive because the driving TFT N2 has an n-type channel. Intensity of a current flowing through the driving TFT N2 depends on the data voltage Vdata stored in the storage capacitor C1 and the driving voltage VDD, and the organic light-emitting diode OLED emits light according to the intensity of the current.

In the two-transistor and one-capacitor pixel structure, to continuously keep the driving TFT N2 ON after applying the positive data voltage Vdata, the driving TFT N2 including amorphous silicon (a-Si:H) receives the positive voltage stored in the capacitor C. This further increases deterioration of the driving TFT N2, and a threshold voltage of the driving TFT N2 changes.

FIG. 3 is a graph illustrating change of a threshold voltage due to deterioration of a thin film transistor. In FIG. 3, a curve A shows current-voltage characteristics of the thin film transistor before the thin film transistor is deteriorated. A curve B shows current-voltage characteristics of the thin film transistor after the thin film transistor is continuously supplied with a positive voltage and is deteriorated. A threshold voltage $V_{th2}$ of the curve B is higher than a threshold voltage $V_{th1}$, of the curve A.

The deterioration reduces a lifetime of the driving TFT, and the brightness of the organic light-emitting diode OLED decreases.

SUMMARY

An organic electroluminescent display device and a driving method of the same are presented in which thin film transistors of the device are prevented from deteriorating and high quality images are displayed.

In one aspect, an organic electroluminescent display device includes an organic light-emitting diode, a first transistor outputting a data voltage by an nth scan signal (n is a natural number), a second transistor providing a current to the organic light-emitting by the data voltage, a capacitor storing the data voltage, and a third transistor supplying the second transistor and the capacitor with a pre-charge voltage by an (n−1)th scan signal. The pre-charge voltage has an opposite polarity to the data voltage.

In another embodiment, a driving method for an organic electroluminescent display device including pixels, n scan lines (n is a natural number) and m data lines (m is a natural number) includes sequentially applying scan signals to the scan lines, applying data voltages to the data lines according to the scan signals, and supplying a pre-charge voltage to driving transistors and capacitors of the pixels connected to an nth scan line by an (n−1)th scan signal.

In another embodiment, an organic electroluminescent display device includes an organic light-emitting diode, a first transistor outputting a data voltage by an nth scan signal (n is a natural number), a second transistor providing a current to the organic light-emitting by the data voltage, means for storing the data voltage, and means for supplying the second transistor and the means for storing the data voltage with a pre-charge voltage by an (n−1)th scan signal. The pre-charge voltage has an opposite polarity to the data voltage It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate an embodiment of the present invention and together with the description serve to explain the principles of that invention.

DETAILED DESCRIPTION OF THE ILLUSTRATED EMBODIMENTS

Reference will now be made in detail to an illustrated embodiment of the present invention, examples of which are shown in the accompanying drawings.

Figure 1:
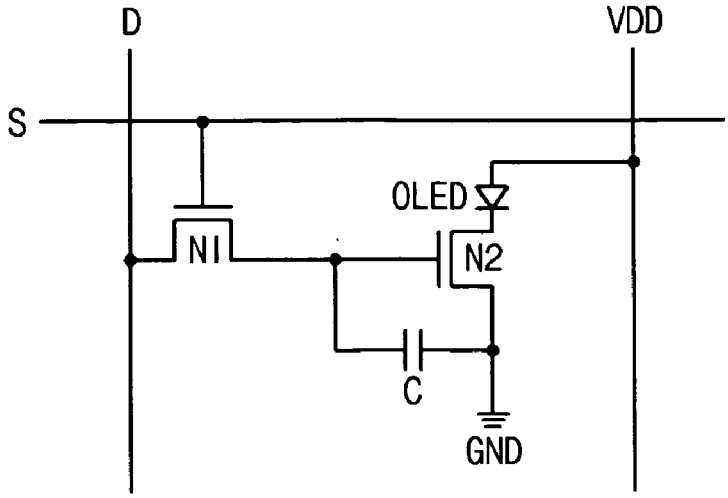
FIG. 1 (RELATED ART)
FIG. 1 is an equivalent circuit for a pixel of an OELD device according to the related art.
Figure 2:
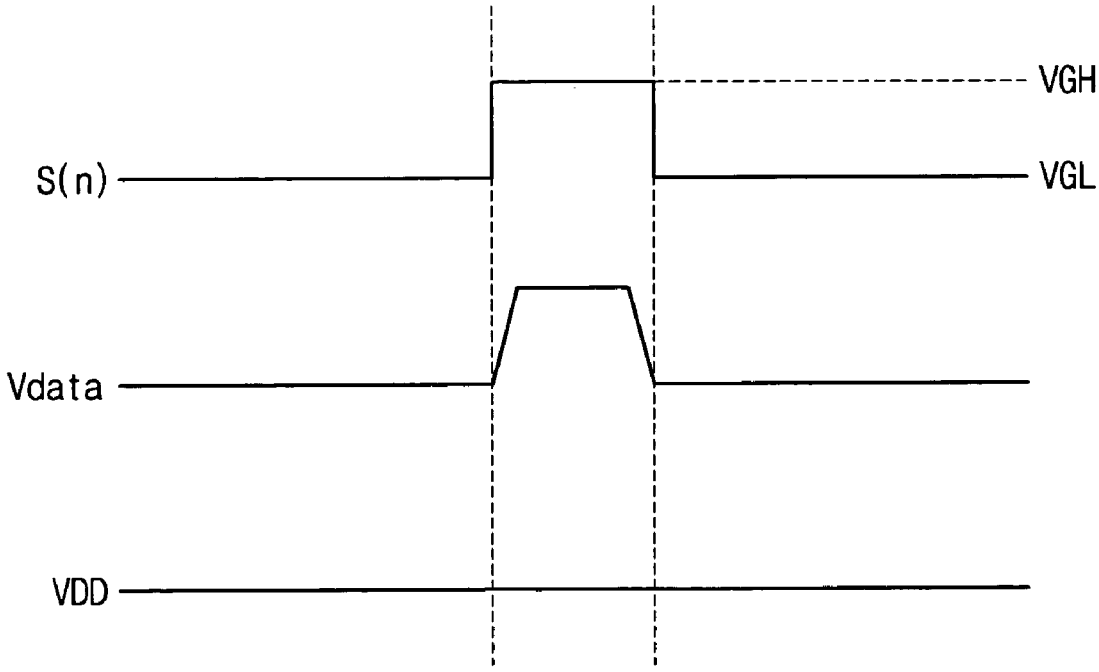
FIG. 2 (RELATED ART)
FIG. 2 is a timing chart of an OELD device.
Figure 3:
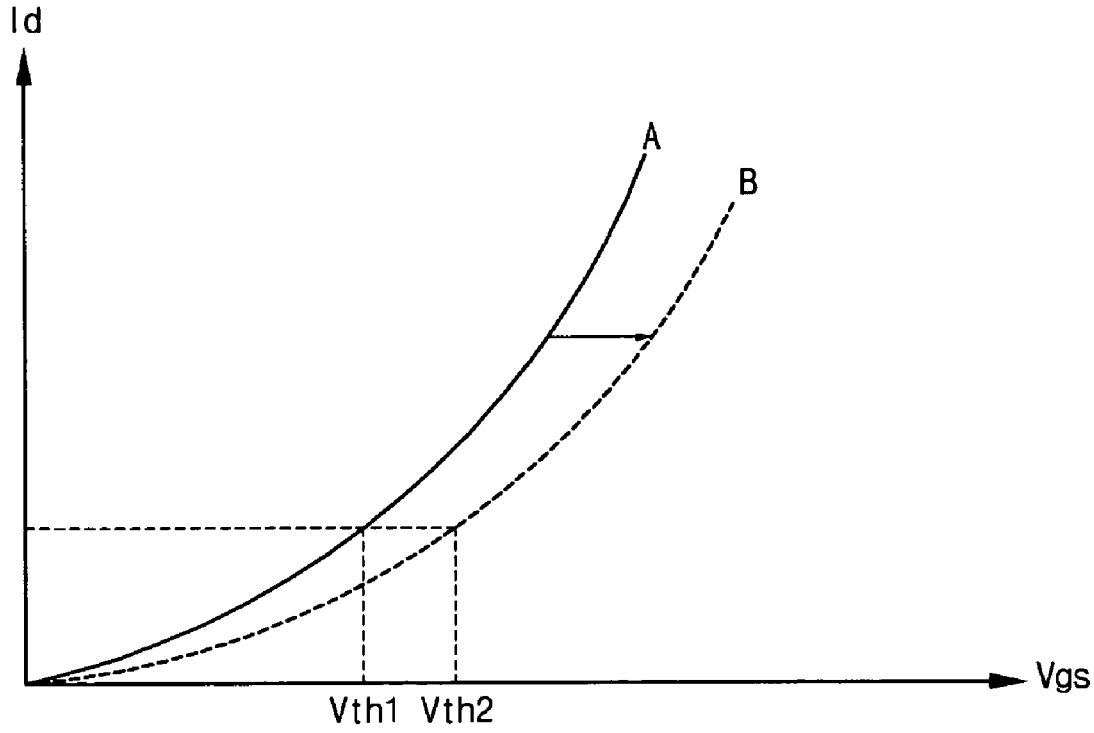
FIG. 3 (RELATED ART)
FIG. 3 is a graph illustrating change of a threshold voltage due to deterioration of a thin film transistor.
Figure 4:
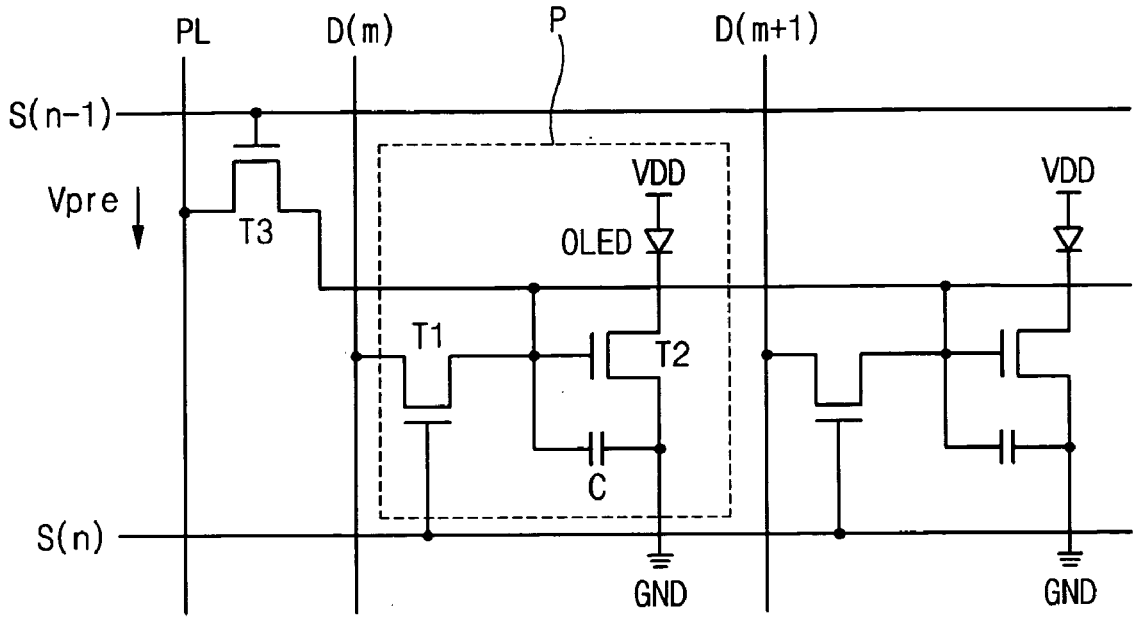
FIG. 4 is an equivalent circuit of an OELD device according to a first embodiment of the present invention.

FIG. 4 is an equivalent circuit of an organic electroluminescent display (OELD) device according to a first embodiment of the present invention.

In FIG. 4, scan lines S(n−1) and Sn (n is a natural number) and data lines Dm and D(m+1) (m is a natural number) are arranged in a matrix form to define pixels P. Each pixel P includes a first transistor T1, a second transistor T2, a capacitor C, and an organic light-emitting diode OLED are formed. A third transistor T3 is connected at one end of each scan line S(n−1) and Sn.

The first transistor T1 is connected to one of the scan lines S(n−1) and Sn and one of the data lines Dm and D(m+1). That is, a gate electrode of the first transistor T1 is connected to one of the scan lines S(n−1) and Sn, and a source electrode of the first transistor T1 is connected to one of the data lines Dm and D(m+1). A gate electrode of the second transistor T2 is connected to a drain electrode of the first transistor T1, a drain electrode of the third transistor T3, and one electrode of the capacitor C. A source electrode of the second transistor T2 is connected to the other electrode of the capacitor C and a ground GND. A drain electrode of the second transistor T2 is connected to a cathode electrode of the organic light-emitting diode OLED. An anode electrode of the organic light-emitting diode OLED is connected to a power supply line VDD.

A source electrode of the third transistor T3 is connected to a pre-charge line PL. A gate electrode of the third transistor T3, which is connected to the second transistors T2 of pixels P supplied with a signal from the nth scan line Sn, is connected to the (n−1)th scan line S(n−1). A pre-charge voltage Vpre is applied to the third transistor T3 through the pre-charge line PL, and the third transistor T3 connected to one scan line provides the pre-charge voltage Vpre to the second transistors T2 and the capacitors C of the pixels P connected to the next scan line. For convenience of explanation, there shows only the third transistor T3 connected to the (n−1)th scan line S(n−1) in the figure.

The first, second and third transistors T1, T2 and T3 preferably all include amorphous silicon and have the same type channel. The first, second and third transistors T1, T2 and T3 may have an n-type channel, for example. The third transistor T3 and the pre-charge line PL may be disposed in a non-display area where images are not displayed.

The first transistor T1 is switched ON and OFF by a scan signal and outputs a data voltage applied from the data line Dm and D(m+1) into the second transistor T2. The second transistor T2 adjusts currents flowing through its channel according to the data voltage and controls a brightness of light emitted from the organic light-emitting diode OLED. The capacitor C stores the data voltage output from the first transistor T1 and provides the stored data voltage to the second transistor T2 when the first transistor T1 finishes outputting the data voltage, thereby continuing light-emitting time of the organic light-emitting diode OLED.

When a scan signal is applied to the (n−1)th scan line S(n−1) in order to operate the pixels P in an (n−1)th horizontal row in the context of the figure, the third transistor T3 connected to the (n−1)th scan line S(n−1) turns ON and provides a pre-charge voltage Vpre to the second transistors T2 and the capacitors C of the pixels P in an nth horizontal row in the context of the figure. The pre-charge voltage Vpre has an opposite polarity to the data voltage. That is, if the second transistor T2 has an n-type channel, the data voltage may be positive. Accordingly, the pre-charge voltage Vpre may be negative. For example, the pre-charge voltage Vpre may have a value within a range of about −5V to about −10V. If the second transistor T2 has a p-type channel, the data voltage may be negative, and the pre-charge voltage Vpre may be positive.

Figure 5:
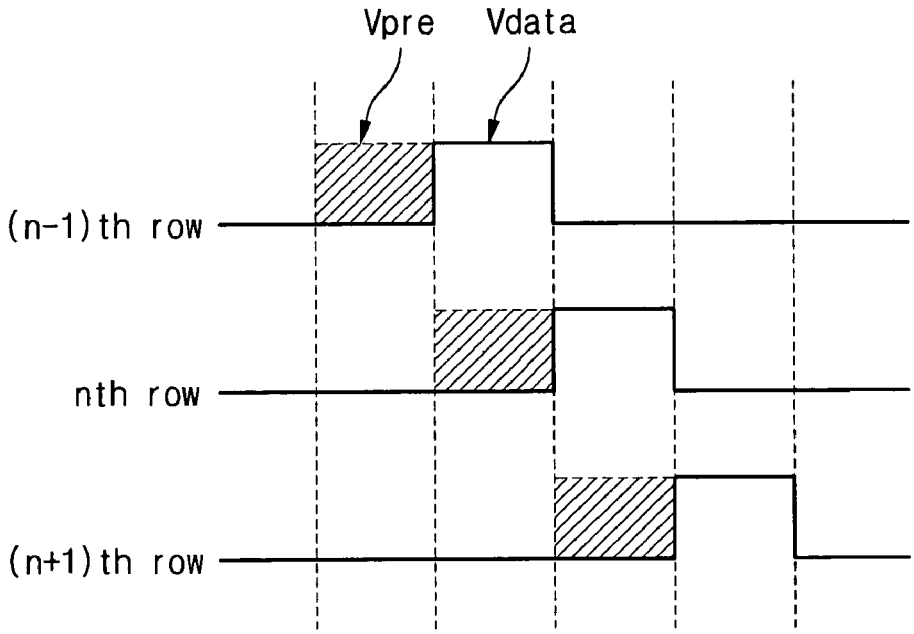
FIG. 5 shows a schematic timing chart for a data voltage and a pre-charge voltage of an OELD device according to embodiments of the present invention.

FIG. 5 shows a schematic timing chart for a data voltage and a pre-charge voltage of an organic electroluminescent display device according to the present invention. The data voltage Vdata and the pre-charge voltage Vpre are supplied to the second transistors T2 in a horizontal row in the context of the figure. Here, the data voltage is positive, and the pre-charge voltage Vpre is negative.

In FIG. 5, the negative pre-charge voltage Vpre is applied to the second transistors T2 and the capacitors C of the pixels P in a horizontal row that will be driven next time through the third transistor T3. After that, the positive data voltage Vdata is applied to the second transistors T2 and the capacitors C of the pixels P in the horizontal row in the context of the figure. Accordingly, the second transistors T2 are prevented from deteriorating and having changed characteristics due to continuous supply of the positive data voltage Vdata. Charges remaining in the capacitors C are discharged due to the negative pre-charge voltage Vpre. Therefore, the next data voltage Vdata is not stored with the previous data voltage Vdata, and more definite images can be displayed.

Figure 6:
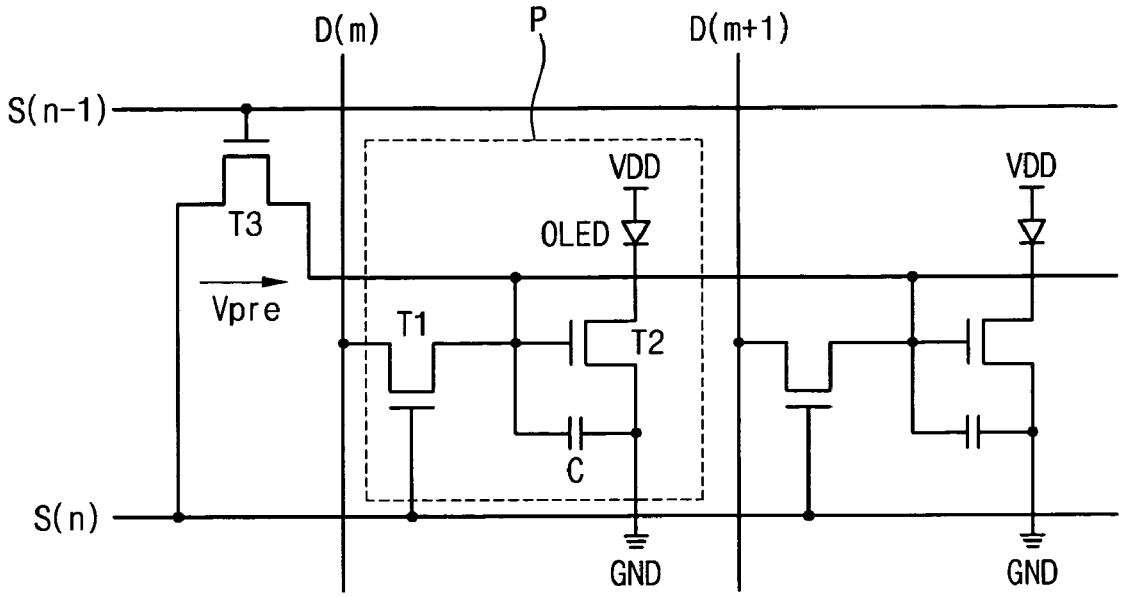
FIG. 6 is an equivalent circuit of an OELD device according to a second embodiment of the present invention.

FIG. 6 is an equivalent circuit of an OELD device according to a second embodiment of the present invention. The OELD has a plurality of pixels, and a structure and an operation of the pixel are the same as that of the first embodiment of FIG. 4. The explanation for the structure and the operation of the pixel will be abbreviated.

In FIG. 6, a third transistor T3 is connected at one end of each scan line S(n−1) and Sn. A gate electrode of the third transistor T3, which is connected to second transistors T2 of pixels P supplied with a signal from the nth scan line Sn, is connected to the (n−1)th scan line S(n−1). A source electrode of the third transistor T3 is connected to the nth scan line Sn, and a drain electrode of the third transistor T3 is connected to the second transistors T2 and capacitors C of the pixels P supplied with a signal from the nth scan line Sn. For convenience of explanation, only the third transistor T3 connected to the (n−1)th scan line S(n−1) are shown in the figure.

When a scan signal, that is, a high level voltage, is applied to the (n−1)th scan line S(n−1), the third transistor T3 provides the second transistors T2 and the capacitors C of the pixels P connected with the nth scan line Sn with a low level voltage of the nth scan line Sn as a pre-charge voltage Vpre.

The first, second and third transistors T1, T2 and T3 all include amorphous silicon and have the same type channel. The first, second and third transistors T1, T2 and T3 may have an n-type channel, for example. The third transistor T3 may be disposed in a non-display area where images are not displayed.

The first transistor T1 is switched ON and OFF by a scan signal and outputs a data voltage applied from the data line Dm and D(m+1) into the second transistor T2. The second transistor T2 adjusts currents flowing through its channel according to the data voltage and controls a brightness of light emitted from the organic light-emitting diode OLED. The capacitor C stores the data voltage output from the first transistor T1 and provides the stored data voltage to the second transistor T2 when the first transistor T1 finishes outputting the data voltage, thereby continuing light-emitting time of the organic light-emitting diode OLED.

With reference to FIG. 5, when a scan signal, that is, a high level voltage, is applied to the (n−1)th scan line S(n−1) in order to operate the pixels P in an (n−1)th horizontal row in the context of the figure, the third transistor T3 connected to the (n−1)th scan line S(n−1) turns ON and provides a low level voltage of the nth scan line Sn, that is, a pre-charge voltage Vpre, to the second transistors T2 and the capacitors C of the pixels P in an nth horizontal row in the context of the figure. For example, the pre-charge voltage Vpre may have a value within a range of about −5V to about −10V.

In the same way as the first embodiment, the negative pre-charge voltage Vpre is applied to the second transistors T2 and the capacitors C of the pixels P in a horizontal row that will be driven next time through the third transistor T3. After that, a positive data voltage is applied to the second transistors T2 and the capacitors C of the pixels P in the horizontal row in the context of the figure. Accordingly, the second transistors T2 are prevented from deteriorating and having changed characteristics due to continuous supply of the positive data voltage. Charges remaining in the capacitors C are discharged due to the negative pre-charge voltage Vpre. Therefore, the next data voltage Vdata is not stored with the previous data voltage Vdata, and more definite images can be displayed.

It will be apparent to those skilled in the art that various modifications and variation can be made in an organic electroluminescent display device of the present invention without departing from the spirit or scope of the invention. Thus, it is intended that the present invention cover the modifications and variations of this invention provided they come within the scope of the appended claims and their equivalents.

What is claimed is:

1. An organic electroluminescent display device, comprising:

pixels each including:

an organic light-emitting diode;

a first transistor outputting a data voltage according to an nth scan signal (n is a natural number);

a second transistor providing a current to the organic light-emitting diode according to the data voltage; and a capacitor storing the data voltage; and a third transistor directly supplying the second transistors and the capacitors of the pixels connected to an nth scan line with a pre-charge voltage according to an (n−1)th scan signal, the pre-charge voltage having an opposite polarity to the data voltage, wherein a source electrode of the third transistor is connected to an nth scan line providing the nth scan signal to the first transistor, wherein a signal of the nth scan line consists of a high level voltage and a low level voltage, wherein the nth scan line provides the first transistor with the high level voltage as the nth scan signal, and wherein the third transistor provides the second transistors and the capacitors of the pixels connected to the nth scan line with the low level voltage as the pre-charge voltage.

2. The device of claim 1, wherein the first, second and third transistors include amorphous silicon.

3. The device of claim 1, wherein the first, second and third transistors have an n-type channel.

4. The device of claim 1, wherein the capacitor is disposed between a gate electrode of the second transistor and a ground.

5. The device of claim 1, wherein the data voltage is positive and the pre-charge voltage is negative.

6. The device of claim 1, wherein the pre-charge voltage has a value within a range of about −5V to about −10V.

7. The device of claim 1, wherein n is larger than two.

8. A driving method for an organic electroluminescent display device including pixels each including a first transistor, a second transistor and a capacitor, n scan lines (n is a natural number), m data lines (m is a natural number), and a third transistor, the method comprising:

sequentially applying scan signals to the scan lines;

applying data voltages to the data lines according to the scan signals; and directly supplying a pre-charge voltage to the second transistors and the capacitors of the pixels connected to a kth scan line (k is a natural number equal to or less than n) through the third transistor according to a (k−1)th scan signal, wherein a source electrode of the third transistor is connected to the kth scan line providing a kth scan signal to the first transistor, and the pre-charge voltage is provided from the kth scan line, wherein a signal of the kth scan line consists of a high level voltage and a low level voltage, wherein the kth scan line provides the first transistor with the high level voltage as the kth scan signal, and wherein the third transistor provides the second transistors and the capacitors of the pixels connected to the kth scan line with the low level voltage as the pre-charge voltage.

9. The method of claim 8, wherein the pre-charge voltage has an opposite polarity to the data voltages.

10. An organic electroluminescent display device, comprising:

pixels each including:

an organic light-emitting diode;

a first transistor outputting a data voltage according to an nth scan signal (n is a natural number);

a second transistor providing a current to the organic light-emitting diode according to the data voltage; and first means for storing the data voltage; and a second means for directly supplying the second transistors and the first means for storing the data voltage of the pixels connected to an nth scan line with a pre-charge voltage according to an (n−1)th scan signal, the pre-charge voltage having an opposite polarity to the data voltage, wherein a source electrode of the second means is connected to the nth scan line providing the nth scan signal to the first transistor, wherein a signal of the nth scan line consists of a high level voltage and a low level voltage, wherein the nth scan line provides the first transistor with the high level voltage as the nth scan signal, and wherein the second means provides the second transistors and the capacitors of the pixels connected to the nth scan line with the low level voltage as the pre-charge voltage.

* * * * *